US008648733B2

(12) United States Patent
Dopf et al.

(10) Patent No.: US 8,648,733 B2
(45) Date of Patent: Feb. 11, 2014

(54) ELECTROMAGNETIC TELEMETRY ASSEMBLY WITH PROTECTED ANTENNA

(75) Inventors: Anthony R. Dopf, Calgary (CA); Derek W. Logan, Calgary (CA); Garry Holmen, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 507 days.

(21) Appl. No.: 12/812,440

(22) PCT Filed: Jan. 9, 2009

(86) PCT No.: PCT/CA2009/000025

§ 371 (c)(1),
(2), (4) Date: Jul. 22, 2011

(87) PCT Pub. No.: WO2009/086637

PCT Pub. Date: Jul. 16, 2009

(65) Prior Publication Data

US 2011/0309949 A1 Dec. 22, 2011

Related U.S. Application Data

(60) Provisional application No. 61/006,400, filed on Jan. 11, 2008.

(51) Int. Cl.
*G01V 3/00* (2006.01)

(52) U.S. Cl.
USPC ..... 340/854.4; 340/854.6; 175/40; 343/720; 343/872; 343/873

(58) Field of Classification Search
USPC ..... 340/854.4, 854.6; 175/40; 343/720, 343/872–873
See application file for complete search history.

(56) References Cited

U.S. PATENT DOCUMENTS

| | | | | |
|---|---|---|---|---|
| 4,510,797 | A | 4/1985 | Guidry et al. | |
| 4,845,493 | A | 7/1989 | Howard | |
| 6,098,727 | A * | 8/2000 | Ringgenberg et al. | 175/325.2 |
| 7,255,183 | B2 | 8/2007 | Cramer | |
| 2005/0068703 | A1 | 3/2005 | Dopf et al. | |

FOREIGN PATENT DOCUMENTS

| | | |
|---|---|---|
| CA | 2584691 | 10/2007 |

OTHER PUBLICATIONS

International Search Report and Written Opinion dated Apr. 9, 2009 for related Canadian PCT Application No. PCT/CA2009/000025.

* cited by examiner

*Primary Examiner* — Albert Wong
(74) *Attorney, Agent, or Firm* — Ryan A. Schneider; Troutman Sanders LLP

(57) ABSTRACT

Oilfield drilling utilizes downhole data transmitted to surface for formation evaluation and steering of directional wellbores. A leading technology in providing subsurface to surface communication is Electro-Magnetic (EM) Telemetry. This technology is typically employed with a downhole antenna concentric with the bore of an electrically insulating "gap sub" portion of the system. The antenna blocks the bore from further use to conduct other sensors or equipment through. One aspect of the invention is to integrate the antenna into the structure of the gap sub, thereby clearing the bore for conducting other tools through, and also protecting the antenna from the harsh drilling environment, including abrasion, erosion, shock, and vibration. Another aspect of this invention enables the antenna to serve a secondary function as an anti-rotation feature between the two halves of the gap sub.

19 Claims, 4 Drawing Sheets

Figure 1
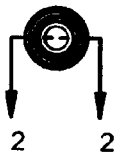
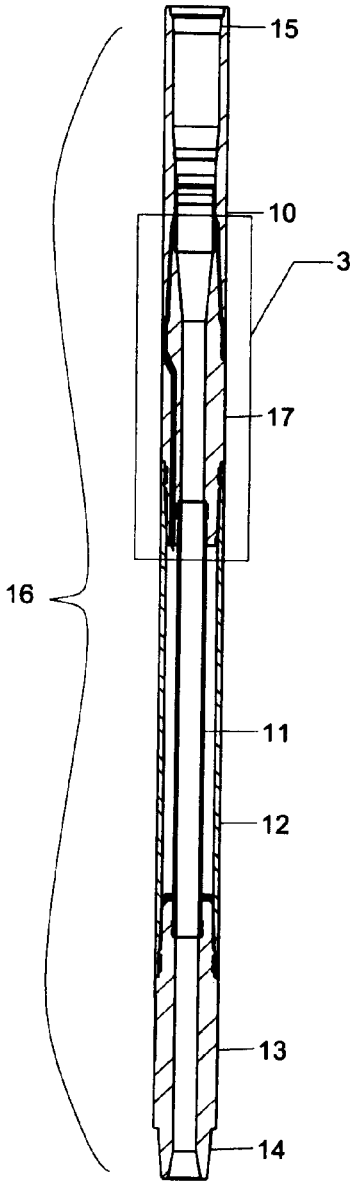
Figure 2
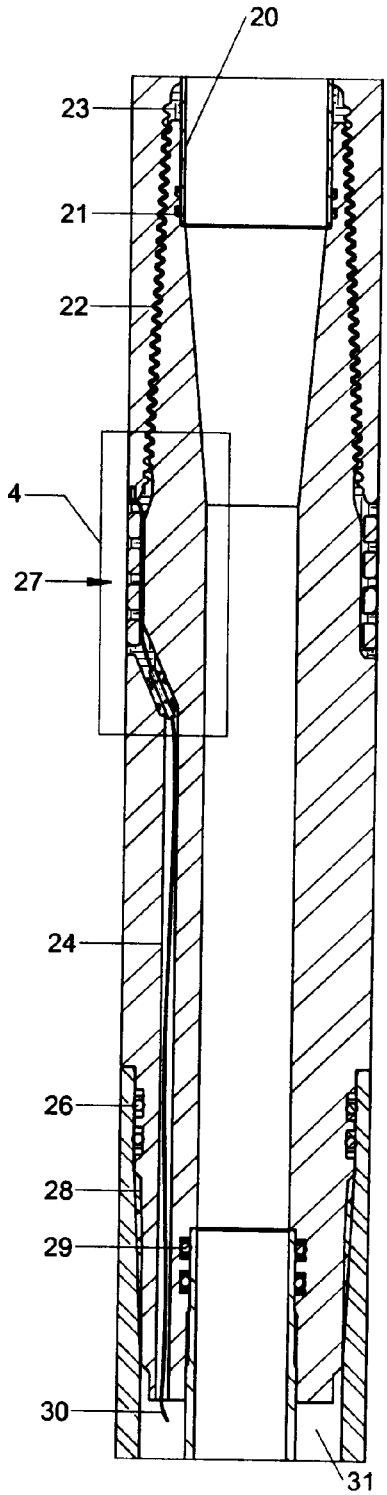
Figure 3

Figure 5
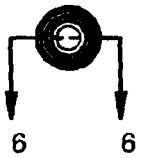
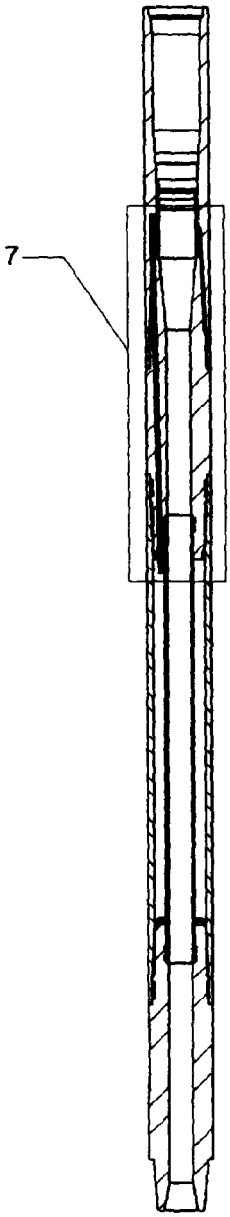
Figure 6
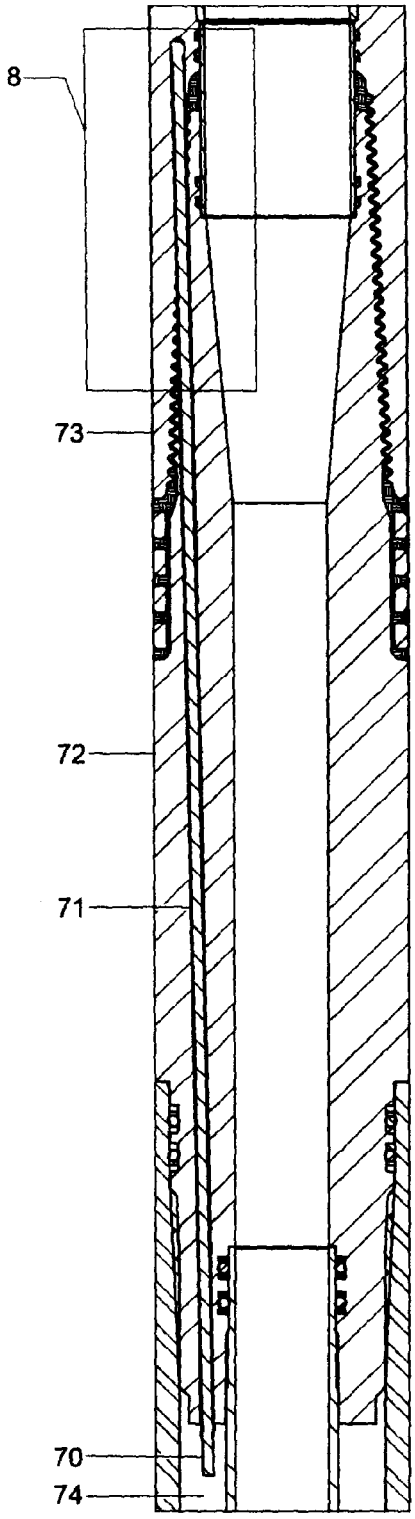
Figure 7

ELECTROMAGNETIC TELEMETRY ASSEMBLY WITH PROTECTED ANTENNA

BENEFIT CLAIMS

This application is a U.S. National Stage of International Application No. PCT/CA2009/000025, filed 9 Jan. 2009, which claims the benefit of U.S. Provisional Patent Application 61/006,400, filed 11 Jan. 2008.

FIELD OF THE INVENTION

The field of the invention relates generally to measurement while drilling, and in particular to an electromagnetic telemetry assembly with a protected antenna.

BACKGROUND OF THE INVENTION

It is known in the oilfield drilling industry to take measurements near a drill bit to assist in evaluating and locating a well, based on geological, geometrical, and environmental parameters. This information may be stored in memory for later retrieval and/or telemetered to surface in near real-time in a technique known as Measurement While Drilling ("MWD").

A common method of MWD transmission to surface uses a low frequency Electro-Magnetic ("EM") signal created by applying an alternating voltage across an insulating joint in the drill string, thereby inducing a current to flow through the earth formation and back to surface where it is detected by sensitive receivers. The insulating joint or "gap joint" is often formed as part of a component of the drill string known as the "gap sub", wherein the "gap" refers to a length of non-conductive material interposed between two conductive metal tubular components and the term "sub" refers to a short length of drill collar.

In some prior art examples of gap sub designs, there are disclosed a rigid insulated antenna connection which traverses the length of the gap sub along the axis of the bore. This antenna and any additional fixturing to hold it partially obstructs the bore, precluding further use of the bore to conduct logging tools or other equipment there-through.

In other prior art gap sub designs, the presence of an antenna is not specifically disclosed, and instead, it is known to use a probe containing an insulated signal conductor along with other electronics required to produce the transmission signal; the conductor traverses the length of the gap sub along the axis of the bore thereby making electrical contact on both sides of the gap joint to effect signal transmission. While it is often economical and convenient to contain the electronics, batteries, and sensors in a probe centered along the gap sub axis (and thus has become the industry standard), the use of a probe obstructs the bore, and prevents the bore for being used to conduct additional equipment there-through.

Sub-surface signal transmitting apparatus are known in other applications, such as post-well drilling formation evaluation. However, such apparatus not being used in drilling applications do not have the necessary structural properties for use in a drill string. For example, such apparatus typically have cabling and batteries located in exposed locations on the outside of the apparatus which thus would be exposed to damage when used in a drilling application.

It is therefore desirable to provide to an EM telemetry assembly for use in a drill string that provides a solution to at least some of the deficiencies in the prior art.

BRIEF SUMMARY OF THE INVENTION

According to one aspect of the invention, there is provided an EM telemetry gap sub which comprises: (a) an electrically conductive housing having a body with a bore there-through and a threaded end; (b) an electrically conductive end coupling having a body with a bore there-through, an electronics cavity end, and an opposite threaded end threaded into the threaded end of the housing, (c) an insulated gap joint comprising a dielectric material in an annular gap between the threaded ends of the housing and end coupling; (d) a passage extending longitudinally through the end coupling body from the electronics cavity end to the threaded end; and (e) a conductor having an insulated covering and extending from the electronics cavity end, through the passage, through the gap joint and electrically connected to the housing. The conductor is electrically connectable to the EM telemetry electronics package to serve as an antenna there-for.

According to another aspect of the invention, there is provided an EM telemetry assembly comprising the aforementioned gap sub, a mandrel connected at one end to the end coupling and having a body with a bore there-through, an electronics housing in the mandrel bore spaced from the mandrel body and connected at one end to the end coupling, wherein the space between the mandrel body and electronics housing defines an electronics cavity; an EM telemetry electronics package in the electronics cavity and electrically coupled to the conductor.

A first portion of the conductor can be an electrically conductive core of a transmission wire extending through the passage from the electronics cavity end to the threaded end. The EM telemetry gap sub can further comprise a feed-through seated in the threaded end of the passage and which comprises an electrically insulating body and wherein a second portion of the conductor is a feed-through conductor segment which extends through the insulating body and is electrically connected to one end of the transmission wire. A third portion of the conductor can be an antenna wire extending through the gap joint and having one end electrically connected to the feed-through conductor segment and an opposite end electrically connected to the housing.

The passage can further extend through the gap joint and into the housing body, and the conductor can be a conductive rod and the insulating covering can be a jacket surrounding the rod. The rod and jacket extend through the passage such that the rod extends through the end coupling and into the housing thereby serving to impede rotation between the housing and end coupling.

The jacket can be composed of a material having properties which acts as an electrical barrier at the expected downhole operating temperatures of the gap sub. In particular, the jacket can be composed of a material selected from the group consisting of: fiberglass reinforced epoxy, heat shrink tubing, curable silicone elastomer, powder coated paint, polyetheretheketone, and polyamideimide.

The EM telemetry gap sub can further comprise an electrically conductive compression spring located in the end of the passage extending into the housing body and in electrical contact with the body and the rod.

The gap sub provides a clear bore and also protects the antenna from damage in the harsh drilling environment. The gap sub accomplishes this by embedding the antenna within the structure of the gap joint, either before or after the gap dielectric material is applied.

BRIEF DESCRIPTION OF THE DRAWINGS

FIG. 1 is an end view of an EM telemetry assembly having a clear bore and a protected antenna according to a first embodiment of the invention.

FIG. 2 is a side section view of the EM telemetry assembly.

FIG. 3 is a detail side section view of a gap sub portion of the EM telemetry assembly, including integrated antenna wiring, and a partial view of an electronics cavity.

FIG. 5 is an end view of a second embodiment of the EM telemetry assembly.

FIG. 6 is a side section view of the second embodiment of the EM telemetry assembly.

FIG. 7 is a detail side section view of the gap sub portion of the second embodiment, showing a dual-purpose conductor/anti-rotation rod.

DETAILED DESCRIPTION OF EMBODIMENTS OF THE INVENTION

Figure 4:
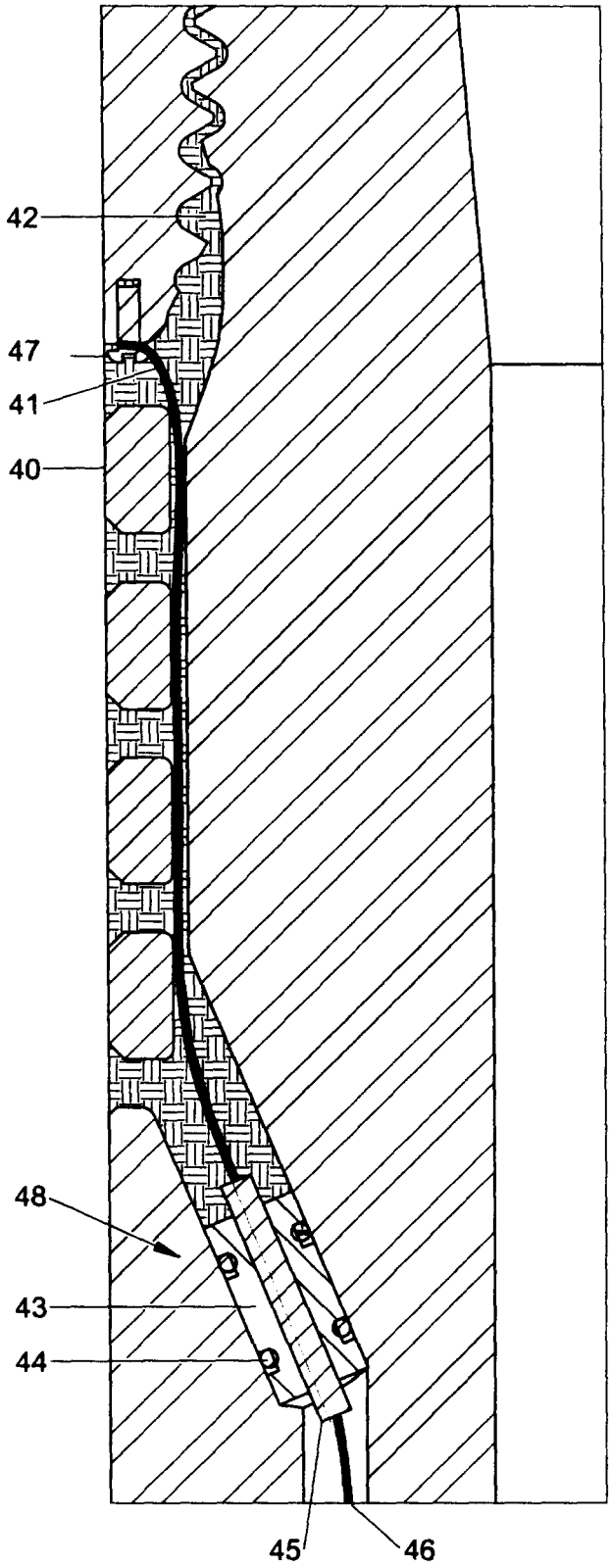
FIG. 4 is a detail side section view of the integrated antenna wiring.
Figure 8:
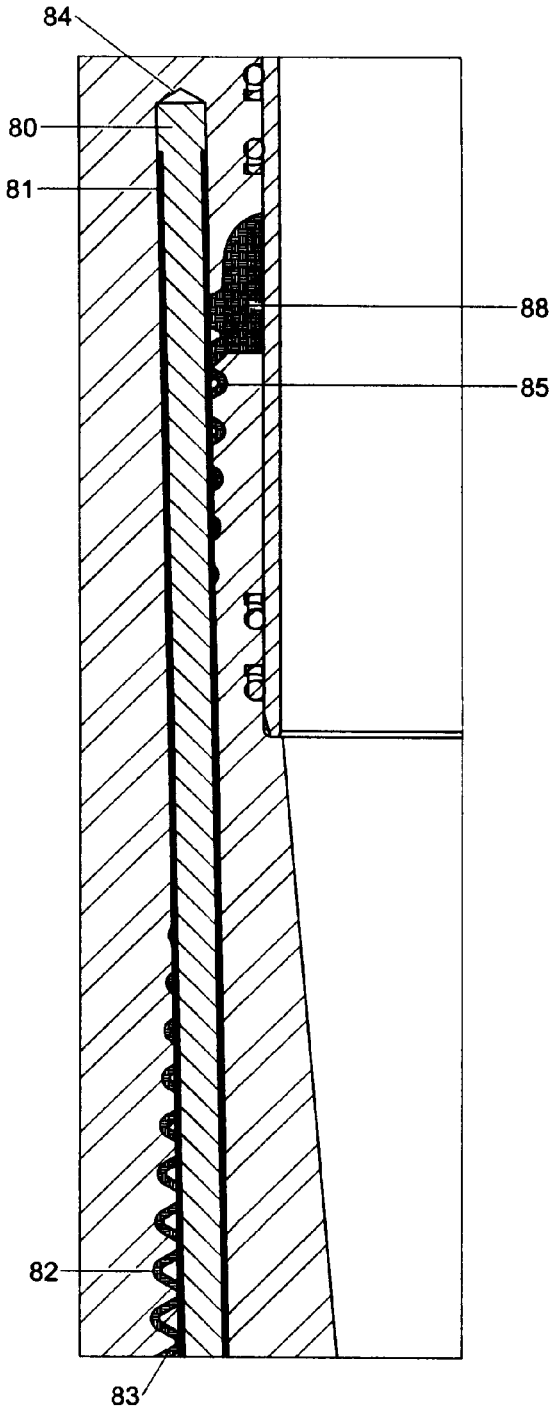
FIG. 8 is a detail side section view of the conductor rod.

In this description, directional terms such as "up", "down", "upper" and "lower" are used merely to help the reader understand the disclosed embodiments and should not be construed to limit the orientation or operation of the embodiments in any way. These directional terms are used in relation to the illustrative embodiments as they are depicted in the Figures, the upward direction being toward the top of the corresponding Figure and the downward direction being toward the bottom of the corresponding Figure.

According to one embodiment of the invention and referring to FIGS. 1 through 4, an EM telemetry assembly 16 includes a gap sub portion (shown in detail in FIGS. 3 and 4) comprising generally of an internally threaded housing 10 and an externally threaded end coupling 17 and dielectric material 42 electrically separating the internally threaded housing 10 from the end coupling 17. The facing and threaded ends of the housing 10 and end coupling 17 when screwed together define a loose fitting annular thread gap 22 therebetween, which is filled with the dielectric material 42. The dielectric material 42 also fills an external annular recess 27 on the outside surface of the end coupling 17 below and adjacent to the thread gap 22 and an internal annular recess 23 on the inside surface of the housing 10 above and adjacent the thread gap 22. Consequently, a non-conductive gap joint provided by the dielectric material 42 extends from the external annular recess 27, through the annular thread gap 22 and to the internal annular recess 23.

The internally threaded housing 10 also contains at an upper end a standard female drill string threaded connection 15 allowing it to be connected to drill-string components above it (not shown). A lower coupling 13 contains at a lower end a standard male drill-string threaded connection 14, which allows it to be connected to drill-string components below it (not shown).

The EM telemetry assembly 16 also contains a mandrel 11, which has a clear bore through its center, allowing the passage of fluids and other equipment there-through, such as a wireline logging tool (not shown). The mandrel 11 is sealed against fluid ingress at its ends by seals 29. Surrounding the mandrel 11 is a tubular electronics housing 12 connected at its lower end to the lower coupling 13 and at its upper end to the end coupling 17. The electronics housing 12 in conjunction with the mandrel 11, lower coupling 13 and the end coupling 17 form a sealed annular electronics cavity 31 with o-ring seals 26.

An elongated wire passage 24 is a drilled hole which extends through the annular body of the end coupling 17, from the bottom end of the end coupling 17 to the external annular recess 27 near the top end of the end coupling 17. The wire passage 24 runs substantially parallel to the bore but is located in the annular portion of this end coupling 17. A transmission wire 46 extends through the wire passage 24 and may be potted to support it against vibration damage. One end of the transmission wire 46 is electrically connected, through the use of solder, crimp, or similar technique, to a lower end of a feed-through conductor 45 of a feed-through 48. The feed-through 48 is seated in the mouth of the wire passage 24 that opens into the annular recess of the end coupling 17. A feed-through 48 is a well known and commercially available part from a supplier such as Greene Tweed, Inc. and consists of an insulating body 43, seals 44 surrounding the body 43 and providing a seal between the body 43 and the antenna passage 24, and the conductor 45 seated within a bore in the body 43. The purpose of the feed-through 48 is to provide a means of passing an electrical conductor through a sealed insulator.

Antenna wiring 41 is electrically coupled at one end to an upper end of the feed-through conductor 45 in a similar manner to the transmission wiring 46. The other end of the antenna wiring 41 is anchored and makes electrical contact solely with the housing 10 through the use of a securing bolt 47 threaded into the end of the housing 10.

The lower end of the transmission wiring 46 extends out of the lower end of the wire passage 24 and into the annular electronics cavity 31. The electronics cavity 31 contains batteries, sensors, and electronics sufficient to measure downhole parameters (collectively, "electronics package"). The electronics package produces a transmission signal consisting of an alternating voltage applied to a conductor end 30 of the insulated transmission wire 46 referenced to a ground return on the end coupling 17.

During assembly of the gap sub, a suitable dielectric material 42 such as a polymer resin is injected into the space between loose fitting and spaced apart threads 22 creating the electrically insulating joint required for the functioning of the EM telemetry assembly 16. The feed-through 48 prevents the polymer resin from flowing into the electronics cavity 31 during injection, and further provides an additional level of protection against fluid ingress once the EM telemetry assembly 16 is in service, and exposed to high pressure drilling fluid downhole.

Protective rings 40 surround the external annular recess 27 of the end coupling 17 and are spaced apart and electrically isolated from each other and from the two halves of the gap joint in the recess by the dielectric material 42. The protective rings 40 serve to protect the softer dielectric material from wear caused by rubbing contact with the borehole and rock cuttings. The protective rings 40 also protect the antenna wiring 41 which runs underneath them. Embedding the antenna directly within the structure of the gap joint has the positive benefit of protecting the wiring 41 from damage due to either internal flow erosion through the bore or external abrasion with the rocks and cuttings of the borehole. An injectable dielectric material 42, such as polymer resin, has the further benefit of rigidly restraining the wiring 41 such that the wiring is not affected by the large shocks and vibrations encountered in the drilling environment.

An internal non-conductive sleeve 20 is mounted in the bore of the gap sub and contacts the dielectric material 42 in the internal annular recess 23. The sleeve 20 increases the length of non-conductive area on the bore of the gap sub. This increases the effective resistance of the internal conductive path through the mud, reducing the amount of wasted current flowing through this non-productive path, and thereby increasing the efficiency of the transmission system as a whole. Furthermore, seals 21 provide an additional level of protection against fluid leakage into the gap joint, should the dielectric material 42 alone not create a sufficient seal.

Referring mow to FIGS. 5 through 9 and according to an alternative embodiment of the invention, there is provided an EM telemetry assembly having many similar features as the embodiment shown in FIGS. 1 to 4, but with the following notable differences. Rather than the antenna connection being made prior to the dielectric material 88 being injected, an alternative is to form the antenna connection after injection. In keeping with the concept of having the antenna embedded within the gap joint, and thus completely protected from internal and external attack, a hole is drilled through the assembled gap sub consisting generally of the end coupling 72, housing 73, and dielectric material 88 to form an elongated passage 71 having a lower end opening into an electronics cavity 74 below the end coupling 72 and a upper end 84 terminating in the body of the housing 73. That is, the passage extends through the entire length of the end coupling 72, through the dielectric material 88 and partway through the housing 73.

Figure 9:
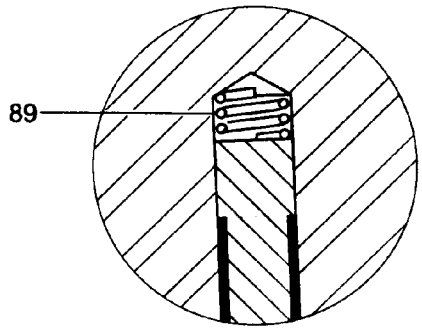
FIG. 9 is a detail view of a compression spring at the end of the conductor rod.

A metallic conductor rod 70 with an insulating jacket 81 surrounding the rod 70 is installed in the elongated passage 71, and extends from the electronics cavity 74 to the passage upper end 84. Electrical connection may be achieved between the conductor rod top end 80 and housing 73 by a number of means, listed as illustrative, but not intended to be inclusive of all possible techniques which would be available to one skilled in the art. The conductor rod top end 80 may be press fit within the elongated passage 71. This could be achieved with a drilled hole having a internal diameter tolerance of 0.2500"+0.0003"/−0.0000", and the conductor rod end 80 having an external diameter tolerance of 0.2504"+0.0002"/−0.0000" for example, resulting in an interference of 0.0001" to 0.0006". Alternatively and as shown in FIG. 9, a compression spring 89 may be placed in the end of the elongated passage 84, making electrical contact with both conductor rod end 80 and housing 73. Another alternative would be to use a conductive epoxy (not shown) to make electrical contact between conductor rod top end 80 and housing 73

The EM transmission signal from the electronics package (not shown) in the electronics cavity 74 is now applied as an alternating voltage on the conductor rod 70 at the end adjacent to the electronics cavity 74 by means of a soldered electrical connection to the electronic package.

The insulating jacket 81 is necessary as the conductor rod 70 may otherwise short the housing 73 and end coupling 74 together as it passes between external thread 85 and internal thread 82. The insulating jacket 81 may be formed by a wide variety of insulating materials, such as, but not limited to: fiberglass reinforced epoxy, heat shrink tubing, two part curable silicone elastomer, powder coated paint, engineering plastics such as PEEK (Polyetheretherketone), PAI (Polyamide-imide), or any similarly non-conductive material that may act as an electrical barrier at the expected temperatures experienced downhole (up to 150° C./300° F. or hotter as required). These materials may be applied as a preformed tube, a liquid or powder which solidifies, or as a film which is wrapped around the conductor rod.

An additional benefit to having the insulated conductor rod 70 pass through the insulating gap 83, female thread 82 and male thread 85, is that once in place, it has the function of preventing any relative rotation between housing 73 and end coupling 74 due to drilling loads subsequently applied. Additionally, whereas only a single insulated conductor rod is displayed in the drawings, a plurality of insulated conductor rods (not shown) can be provided around the circumference of the gap sub body, increasing the torque resistance as a roughly linear function with the number of insulated conductor rods employed.

While particular embodiments of the present invention has been described in the foregoing, it is to be understood that other embodiments are possible within the scope of the invention and are intended to be included herein. It will be clear to any person skilled in the art that modifications of and adjustments to this invention, not shown, are possible without departing from the spirit of the invention as demonstrated through the exemplary embodiment. The invention is therefore to be considered limited solely by the scope of the claims.

What is claimed is:

1. An electromagnetic telemetry gap sub comprising:

(a) an electrically conductive housing having a body with a bore there-through and a threaded end;

(b) an electrically conductive end coupling having a body with a bore there-through, an electronics cavity end, and an opposite threaded end threaded into the threaded end of the housing;

(c) an insulated gap joint comprising a dielectric material in an annular gap between the threaded ends of the housing and end coupling such that the threaded ends are electrically insulated from each other;

(d) a passage extending longitudinally through the end coupling body from the electronics cavity end to the threaded end; and (e) a conductor having an insulated covering and extending from the electronics cavity end, through the passage, through the gap joint and electrically connected to the housing, the conductor electrically connectable to an electromagnetic telemetry electronics package to serve as an antenna there-for.

2. An electromagnetic telemetry gap sub as claimed in claim 1 wherein a first portion of the conductor is an electrically conductive core of a transmission wire extending through the passage from the electronics cavity end to the threaded end.

3. An electromagnetic telemetry gap sub as claimed in claim 2 further comprising a feed-through seated in the threaded end of the passage and comprising an electrically insulating body and wherein a second portion of the conductor is a feed-through conductor segment which extends through the insulating body and is electrically connected to one end of the transmission wire.

4. An electromagnetic telemetry gap sub as claimed in claim 3 wherein a third portion of the conductor is an antenna wire extending through the gap joint and having one end electrically connected to the feed-through conductor segment and an opposite end electrically connected to the housing.

5. An electromagnetic telemetry gap sub as claimed in claim 1 wherein the passage further extends through the gap joint and into the housing body, and the conductor is a conductive rod and the insulating covering is a jacket surrounding the rod, the rod and jacket extending through the passage such that the rod extends through the end coupling and into the housing thereby serving to impede rotation between the housing and end coupling.

6. An electromagnetic telemetry gap sub as claimed in claim 5 wherein the jacket is composed of a material having properties which acts as an electrical barrier at the expected downhole operating temperatures of the gap sub.

7. An electromagnetic telemetry gap sub as claimed in claim 6 wherein the jacket is composed of a material selected from the group consisting of fiberglass reinforced epoxy, heat shrink tubing, curable silicone elastomer, powder coated paint, polyetheretheketone, and polyamide-imide.

8. An electromagnetic telemetry gap sub as claimed in claim 5 further comprising an electrically conductive compression spring located in the end of the passage extending into the housing body and in electrical contact with the body and the rod.

9. An electromagnetic telemetry assembly comprising:

the gap sub as claimed in claim 1;

a mandrel connected at one end to the end coupling and having a body with a bore therethrough;

an electronics housing in the mandrel bore spaced from the mandrel body and connected at one end to the end coupling, the space between mandrel body and electronics housing defining an electronics cavity; and an electromagnetic telemetry electronics package in the electronics cavity and electrically coupled to the conductor.

10. An electromagnetic telemetry assembly as claimed in claim 9 further comprising an external annular recess on an outside surface of the end coupling and adjacent to and in communication with the annular gap between the threads, and wherein the gap joint further comprises dielectric material which fills the external annular recess and is in contact with the dielectric material in the annular gap between the threads.

11. An electromagnetic telemetry assembly as claimed in claim 10 further comprising a protective ring surrounding the external annular recess and embedded in the dielectric material which fills the external annular recess.

12. An electromagnetic telemetry assembly as claimed in claim 11 further comprising an internal annular recess on an inside surface of the housing adjacent to and in communication with the annular gap between the threads and wherein the gap joint further comprises dielectric material which fills the internal annular recess and is in contact with the dielectric material in the annular gap between the threads.

13. An electromagnetic telemetry assembly as claimed in claim 12 further comprising an internal non-conductive sleeve mounted in the bore of the housing and is in contact with the dielectric material which fills the internal annular recess.

14. An electromagnetic telemetry assembly as claimed in claim 9 wherein the dielectric material is a polymer resin.

15. An electromagnetic telemetry gap sub as claimed in claim 1 further comprising an external annular recess on an outside surface of the end coupling and adjacent to and in communication with the annular gap between the threads, and wherein the gap joint further comprises dielectric material which fills the external annular recess and is in contact with the dielectric material in the annular gap between the threads.

16. An electromagnetic telemetry gap sub as claimed in claim 15 further comprising a protective ring surrounding the external annular recess and embedded in the dielectric material which fills the external annular recess.

17. An electromagnetic telemetry gap sub as claimed in claim 1 further comprising an internal annular recess on an inside surface of the housing adjacent to and in communication with the annular gap between the threads and wherein the gap joint further comprises dielectric material which fills the internal annular recess and is in contact with the dielectric material in the annular gap between the threads.

18. An electromagnetic telemetry gap sub as claimed in claim 17 further comprising an internal non-conductive sleeve mounted in the bore of the housing and is in contact with the dielectric material which fills the internal annular recess.

19. An electromagnetic telemetry gap sub as claimed in claim 1 wherein the dielectric material is a polymer resin.

* * * * *